United States Patent [19]

Basehgi et al.

[11] Patent Number: 5,027,126

[45] Date of Patent: Jun. 25, 1991

[54] BEAM STEERING MODULE

[75] Inventors: Behshad Basehgi, Santa Barbara; Mohammad Mazooji, Santa Barbara, both of Calif.

[73] Assignee: Raytheon Company, Lexington, Mass.

[21] Appl. No.: 353,298

[22] Filed: May 17, 1989

[51] Int. Cl.[5] ..... H01Q 3/22

[52] U.S. Cl. ..... 342/372; 342/377

[58] Field of Search ..... 342/372, 371, 377

[56] References Cited

U.S. PATENT DOCUMENTS

| | | | |
|---|---|---|---|
| 4,217,587 | 8/1980 | Jacomini | 342/372 |
| 4,308,539 | 12/1981 | Birch | 342/377 |
| 4,445,119 | 4/1984 | Works | 342/377 |
| 4,586,047 | 4/1986 | Inacker et al. | 342/372 |
| 4,670,750 | 6/1987 | Lopez | 342/372 |
| 4,688,045 | 8/1987 | Knudsen | 342/377 |
| 4,933,680 | 6/1990 | Shapiro et al. | 342/368 |

*Primary Examiner*—Gregory C. Issing

*Attorney, Agent, or Firm*—Edmund J. Walsh; Richard M. Sharkansky

[57] ABSTRACT

A beam steering module for rapidly applying control signals to a plurality of digital phase shifters in a phased array antenna system. The module can receive and store a plurality of phase shift commands for a plurality of phase shifters. The commands may be quickly applied to the phase shifters to rapidly steer the beam from the antenna array.

12 Claims, 2 Drawing Sheets

BEAM STEERING MODULE

BACKGROUND OF THE INVENTION

This invention relates generally to electronically steered antennas and more particularly to apparatus for controlling a plurality of digital phase shifters in antenna arrays.

It is sometimes desired to control the direction of a single beam from a phased array antenna by an electronic beam steering technique rather than to use a multi-beam technique. Thus, if an electronic beam steering technique is used, a single beam may be controlled so that the centerline of such beam is directed toward almost any desired point within a field of view; on the other hand, if a multi-beam technique is used, the direction of each beam is fixed within a field of view. It follows then that an electronic beam steering technique permits better aiming of a single beam.

Using any known electronic steering technique, the time taken to complete an operational cycle, i.e. the time required to change the direction of a beam, is in the order of 100 microseconds. Even though the time required to switch an individual control element, say a digital phase shifter, is in the order of tens of nanoseconds, any known architecture for electronic steering of a beam from a phased array antenna using hundreds of digital phase shifters requires a settling time in the order of 100 microseconds. Further, if each digital phase shifter incorporates a number of bits (say 5 to control the phase of radio frequency energy to about 10°), any known architecture requires at least one (and probably two) separate control wires for each bit. Obviously, the total number of control wires in any practical application using hundreds of digital phase shifters is in the thousands.

SUMMARY OF THE INVENTION

It is an object of this invention to provide simple circuitry which can quickly change digital control signals applied to digital phase shifters in a phased array system.

It is also an object of this invention to provide an architecture for the circuitry for changing digital control signals to phase shifters which can be fabricated on an integrated circuit.

The foregoing and other objects of this invention are accomplished by incorporating the circuitry for changing digital control signals to phase shifters in a beam steering module. The module contains a means for storing a plurality of control words for the digital phase shifter connected to an antenna element. Steering logic within the module selects the appropriate one of the control words and applies that word to the control input of the digital phase shifter.

According to another feature of the invention, the means for storing control words stores control words for a plurality of array elements. The steering logic applies the selected control words to the appropriate digital phase shifters.

According to a further feature of this invention, receiving means sequentially receives control words from a controller. The control words are temporarily stored in a register bank until a plurality of words are received. The contents of the register bank are then transfered to the storing means, allowing new control words to be received while the steering logic is applying control words to phase shifters.

In another feature of the invention, the module is fabricated on an integrated circuit chip. The chip contains a primary path and a secondary path, each with bus receiving means and storing means. The steering logic selects the values stored in the storing means of one of the paths for application to the digital phase shifters. In addition, the chip contains reconfigure logic which determines from which path received words are read for application to the phase shifter.

The chip also contains test logic. The test logic provides as an output the value of any word applied to the digital phase shifter.

BRIEF DESCRIPTION OF THE DRAWINGS

This invention can be better understood by reference to the following more detailed description and the accompanying drawings in which.

DESCRIPTION OF THE PREFERRED EMBODIMENT

Figure 1:
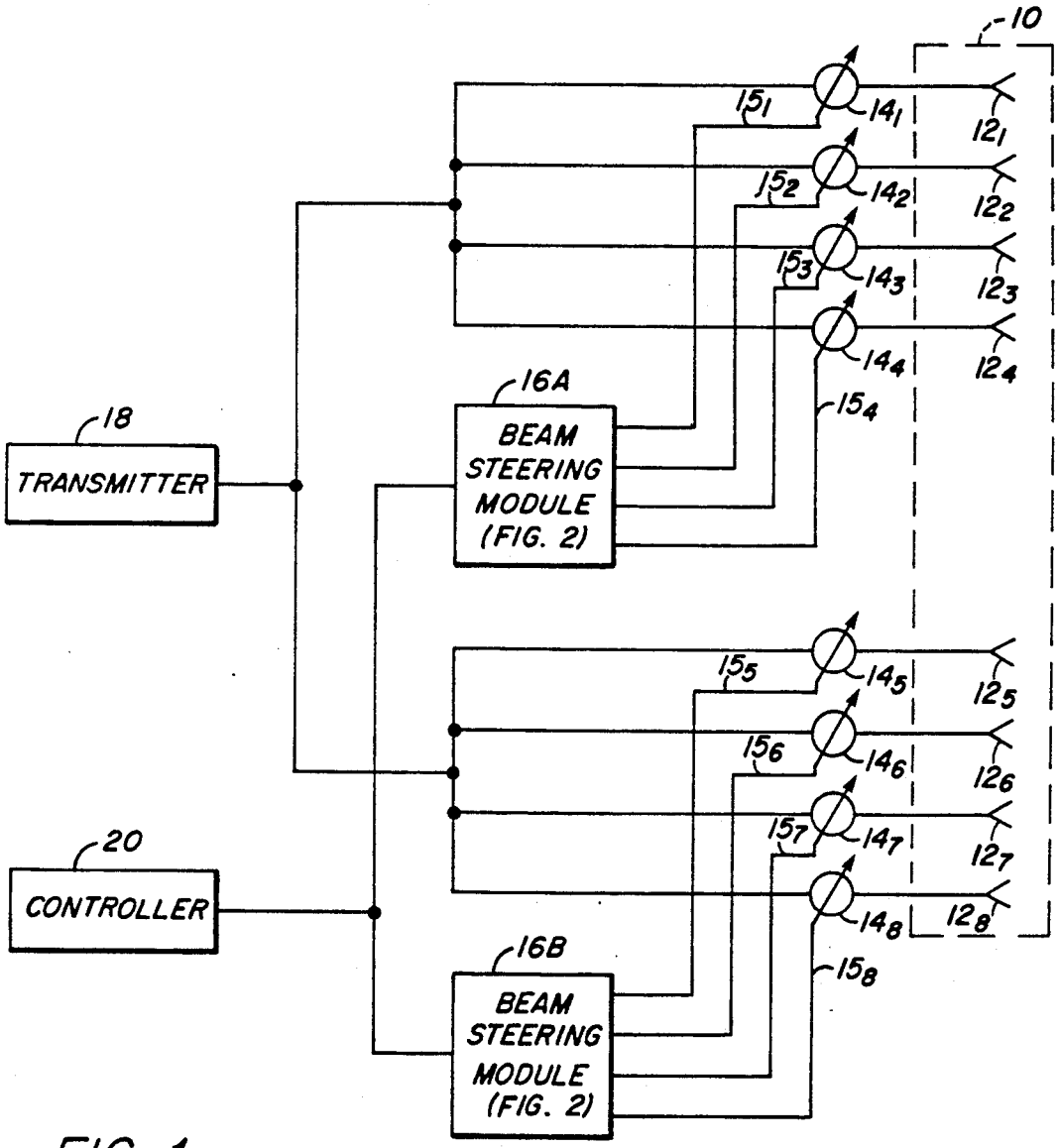
FIG. 1 is a simplified block diagram of a system employing the present invention.

FIG. 1 Shows a system with a phased array antenna 10. Antenna 10 comprises a plurality of antenna elements $\mathbf{12}_1 \ldots \mathbf{12}_8$. Here, a linear array of eight antenna elements is shown. However, this invention is applicable to any size or shape array of elements. The antenna 10 and each of the antenna elements $\mathbf{12}_1 \ldots \mathbf{12}_8$ is constructed according to known techniques.

One of the digital phase shifters $\mathbf{14}_1 \ldots \mathbf{14}_8$ is connected in the path of radio frequency energy to and from each antenna element $\mathbf{12}_1 \ldots \mathbf{12}_8$. Each phase shifter has three ports: a control input $\mathbf{15}_1 \ldots \mathbf{15}_8$; a port (not numbered) connected to one of the antenna elements $\mathbf{12}_1 \ldots \mathbf{12}_8$; and a port (not numbered) connected to transmitter 18. As is known, each digital phase shifter allows radio frequency energy to pass between the connected to transmitter 18 and the port connected to the corresponding antenna element. A phase delay (or phase shift) is introduced in those signals, though, in proportion to the value of the control signal applied to each control input. The digital phase shifters $\mathbf{14}_1 \ldots \mathbf{14}_8$ are constructed in any known manner.

Transmitter 18 is any known source of a signal to be transmitted. The type of signal and transmitter depends on the type of system in which the invention is used. It will be appreciated by one of skill in the art that transmitter 18 could be replaced by a receiver or even a combined transmitter and receiver. Herein, only the use of a transmitter is described for clarity.

The control signals to digital phase shifters $\mathbf{14}_1 \ldots \mathbf{14}_8$ are provided by beam steering modules 16A and 16B. Here, each beam steering module controls four digital phase shifters. However, a beam steering module might be constructed to control any convenient number of phase shifters.

The operation of beam steering modules 16A and 16B are explained below in conjunction with FIG. 2. Suffice it to say here that controller 20 provides commands and data to beam steering modules 16A and 16B. The exact values of the commands and data depend on the system in which the invention is used. These signals tell the beam steering modules 16A and 16B what amount of phase shift is required from each digital phase shifter $14_1 \ldots 14_8$. As described above, the amount of phase shift dictates the direction in which the beam from antenna 10 is transmitted. Additional signals passing between controller 20 and beam steering modules 16A and 16B will become clear by reference to FIG. 2.

Figure 2:
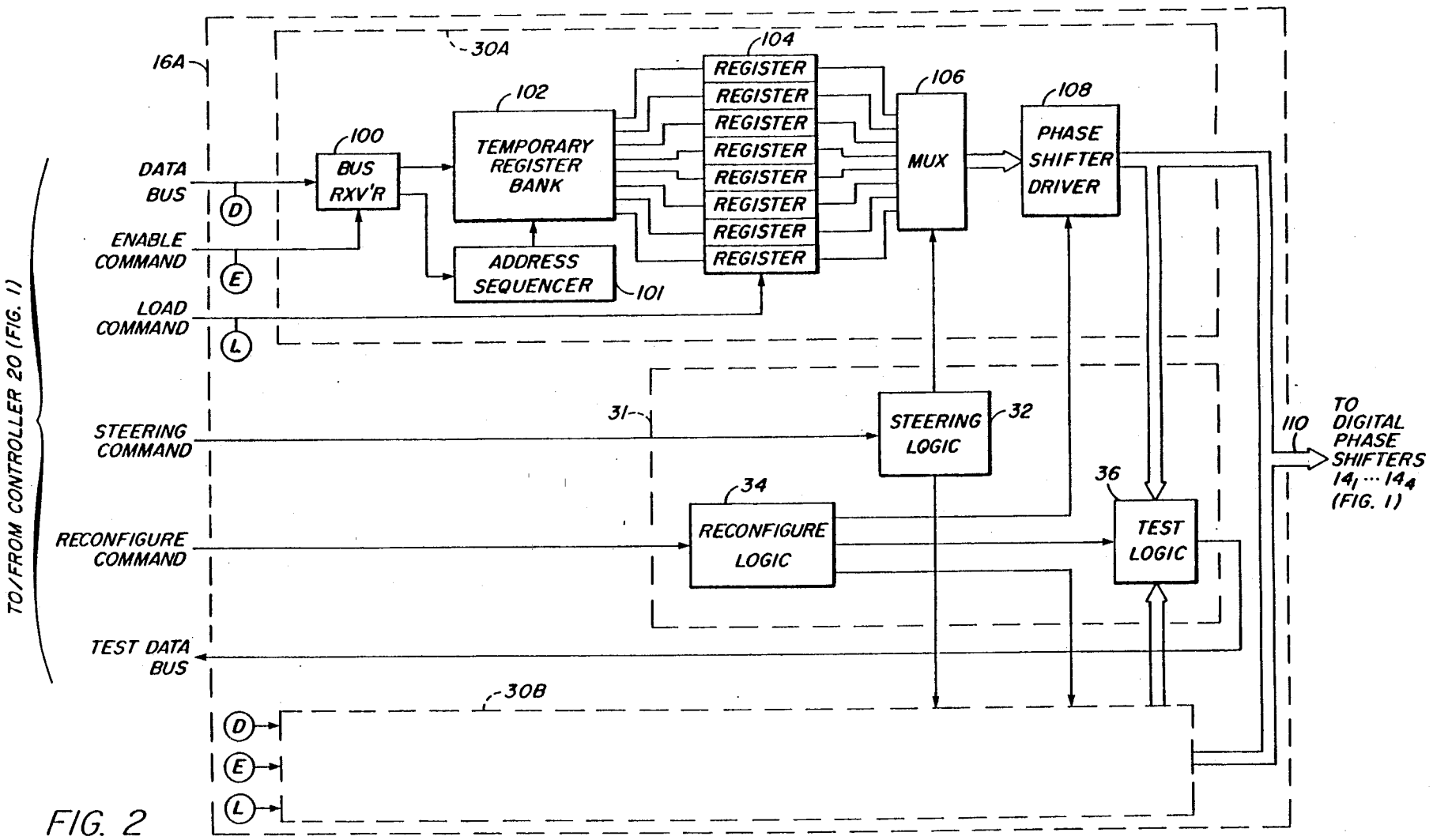
FIG. 2 is a simplified block diagram of a beam steering module according to the present invention.

FIG. 2 shows the connections between beam steering module 16A and controller 20. The connections comprise: a DATA BUS; ENABLE COMMAND; a LOAD COMMAND; a STEERING COMMAND; a RECONFIGURE COMMAND; and a TEST DATA BUS. The purpose of each of these signals will be apparent from the following description of beam steering module 16A.

FIG. 2 shows a block diagram of beam steering module 16A, which is representative of all beam steering modules in the system. Beam steering module 16A is constructed from digital logic circuitry of any known types. The module could be built with discrete, commercially available components. Alternatively, the entire module can be constructed on one or several integrated circuits. The architecture shown in FIG. 2 is particularly suited for fabrication using very large scale integration (VLSI) or very high speed integrated circuit (VHSIC) techniques. One of skill in the art will appreciate the block diagram of FIG. 2 does not explicitly show many standard elements of digital logic circuits. For example, timing connections, power and ground connections, and some control signals are not explicitly shown, but one of skill in the art will recognize that they are required.

Beam steering module 16A has three major sections: primary path 30A, secondary path 30B, and logic section 31. Details of primary path 30A are shown. Secondary path 30B duplicates primary path 30A. The points labeled D, E and L are connected together so that the same inputs are applied to primary path 30A and secondary path 30B. At any given moment, only one of the paths 30A or 30B is operative. Both paths are provided so that the beam steering module 16A can operate even if there is a defect in one of the paths. The circuitry in paths 30A and 308 is controlled by logic section 31.

Each of the control signals $15_1 \ldots 15_4$ (FIG. 1) to digital phase shifters $14_1 \ldots 14_4$ (FIG. 1) here is a digital word with 5 bits. Thus, output line 110 consists of a digital word with 20 bits called a "shifter control word". The circuitry of primary path 30A is therefore designed to handle 20 bit words. The present invention could be used with phase shifters having control signals requiring less than 5 bits. In that case, some of the bits in the 20 bit words are not used or set to zero.

Phase shifter driver 108 places the shifter control word on output line 110. Phase shifter driver 108 performs a buffering function in a known fashion. It ensures the signals on output line 110 have the correct voltage and current characteristics for operation of digital phase shifters $14_1 \ldots 14_4$.

The shifter control word placed on output line 110 is selected from register bank 104 by multiplexer (MUX) 106. Register bank 104 contains eight registers, each capable of storing a word 20 bits long. To construct a 20 bit register, several registers with fewer bits could also be used, but would still function as a 20 bit register. MUX 106 has eight inputs, one connected to each register in register bank 104, and one output. MUX 106 selects one of the registers in register bank 104 and provides the value stored in that register to phase shifter driver 108.

The register selected by MUX 106 is dictated by steering logic 32. In operation, the registers of register bank 104 contain shifter control words which, when applied to digital phase shifters $14_1 \ldots 14_4$ (FIG. 1), will point the beam from antenna 10 (FIG. 1) in a given direction. To change the direction of the beam, different ones of the registers in register bank 104 is selected by MUX 106.

Steering logic 32 applies the appropriate control signals to MUX 106 at the appropriate time. Steering logic 32 gets a command from controller 20 (FIG. 1) on the control lines marked STEERING COMMAND. As seen in FIG. 1, all of the beam steering modules in a system are connected to controller 20. Thus, controller 20 can change the control signals applied to all the digital phase shifters at one time by an appropriate signal on the control line STEERING COMMAND. For example, the control signal on line STEERING COMMAND might be digital signal 011. Steering logic 32 would interpret this signal as a command to apply the digital word in the third register of register bank 104 to output line 110. When the system is configured as shown in FIG. 1, all beam steering modules would respond the same way and new shifter control words would nearly simultaneously be applied to all of the digital phase shifters in the system. The beam from antenna 10 would be steered in a new direction.

It is important to note that new shifter control words can be applied to all digital phase shifters in the system by one control word from controller 20 (FIG. 1). The beam is thus steered very quickly to point in a new direction. With eight registers in register bank 104, the direction of the beam can be quickly switched in this fashion between different ones of eight different directions. If the direction of the beam must be switched quickly between more than eight beam directions, more than eight registers can be included in register bank 104.

The contents of register bank 104 may also be changed if more than eight beam directions are desired. However, the process of changing the contents of the registers is slower than simply selecting a different one of the registers. In the beam steering module of FIG. 2, new contents of the registers can be changed relatively slowly while the relative fast switching of the beam is being directed by steering logic 32. In this way, a beam can be directed in a large number of directions while retaining the advantage of quick switching between different directions.

New contents for the registers in register bank 104 are provided to beam steering module from controller 20 over the DATA BUS. Here, the DATA BUS is a 1 bit wide serial bus constructed using known techniques. Alternatively, a parallel bus or any other known bus configuration could be used. In either case, the bus may also contain additional lines for controlling the passage of information. These lines are commonly called "handshake lines" and are not explicitly shown.

Controller 20 (FIG. 1) places a digital word on the DATA BUS. Controller 20 then places the ENABLE COMMAND line in a logic HI state. The ENABLE COMMAND line thus signals bus receiver 100 to read the word on the DATA BUS.

Bus receiver 100 is digital circuitry of known construction for interfacing with a data bus. Bus receiver 100 passes the received word to temporary register bank 102. Temporary register bank 102 contains a plurality of registers for storing digital words, like register bank 104. Address sequencer 101 generates control signals to temporary register bank 102 to ensure that successively received words are stored in different, sequential registers of temporary register bank 102.

For example, to load eight new shifter control words into beam steering module 16A, controller 20 (FIG. 1) places the ENABLE COMMAND line in the logic HI state. Controller 20 then places the first shifter control word on the DATA BUS. Bus receiver 100 reads this word from the DATA BUS and it is stored in the first register of temporary register bank 102. With the ENABLE COMMAND line still logic HI, controller 20 then transfers the second word. Bus receiver 100 passes this word to temporary register bank 102. Address sequencer 101 selects the second register of temporary register bank 102 and the second shifter control word is stored in the second register. In a like fashion, all eight new shift control words are transferred and stored in successive registers of temporary register bank 102. Controller 20 then places ENABLE COMMAND line back in the logic LO state.

During the entire transfer of eight new shifter control words, controller 20 could also be placing commands on the STEERING COMMAND lines causing the control signals on output line 110 to change. The control signals on output line 110 are read from register bank 104. The new shifter control words are stored in temporary register bank 102 and do not interfere with the words stored in register bank 104.

To transfer shifter control words from temporary register bank 102 to register bank 104, controller 20 (FIG. 1) places a logic HI on LOAD COMMAND line. Each register in register bank 104 corresponds to a register in temporary register bank 102. When the LOAD COMMAND line goes into the logic HI state, the register bank 104 loads each register in register bank 104 with the contents of the corresponding register of temporary register bank 102.

The new shifter control words are loaded into register bank 104 quickly. Here, all eight registers are loaded in parallel. Even though the process of loading temporary register bank 102 was relatively slow, it did not affect the fast switching of the beam. While temporary register bank 102 is being loaded, the shifter control words in register bank 104 can still be applied on output line 110.

Beam steering module 16A is designed to be fabricated as an integrated circuit chip. The utility of such a chip can be enhanced by including test logic 36, reconfigure logic 34 and secondary path 30B.

Secondary path 30B is identical to primary path 30A. The output of secondary path 30B is connected to output line 110 like the output of primary path 30A. The DATA BUS, the ENABLE COMMAND line and the LOAD COMMAND line are also connected to the inputs of secondary path 30B. Logic section 31 is connected to secondary path 30B in the same way it is connected to primary path 30A. Thus, either primary path 30A or secondary path 30B could be used to provide an output on output line 110. Which of the two paths is used is dictated by the output of reconfigure logic 34.

Reconfigure logic 34 sends a control signal to phase shifter driver 108. If this signal is a logic HI, phase shifter driver will place its output onto output line 110. If this signal is a logic LO, phase shifter driver will put no signal on output line 110 and therefore have no effect on the output. When a phase shifter driver is not applying an output, it is said to be in a "high impedance" or "high-Z" state. Since there is a phase shifter driver in primary path 30A and secondary path 30B, reconfigure logic 34 can dictate which path is used.

Besides switching between the primary and secondary paths, reconfigure logic 34 can also initiate a test of the chip. A signal from reconfigure logic 34 causes test logic 36 to operate. Test logic 36 takes the output of either primary path 30A or secondary path 30B and transmits it on the TEST DATA BUS. TEST DATA BUS may be a bus like DATA BUS or may be implemented in any known fashion. Which output is placed on the bus depends on the value of the signal from reconfigure logic 34.

In operation, TEST DATA BUS is connected to controller 20 (FIG. 1). Controller 20 passes a set of shifter control words to beam steering module 16A. Controller 20 thus knows what values should be placed on TEST DATA BUS. If controller 20 detects other values, a fault is indicated. When test logic 36 is placing words on the TEST DATA BUS from the output of primary path 30A, the indicated fault is likely to be in primary path 30A. Controller 20 can then send a signal on the RECONFIGURE COMMAND line to disconnect primary path 30A from the output line 110 and to connect secondary path 30B to output line 110. In this way, the entire beam steering module can still function even if a fault is indicated.

When beam steering module 16A is fabricated as an integrated circuit, many modules can be easily used in one system. All beam steering modules can be connected to controller 20 via the same DATA BUS. This reduces the complexity of the system because fewer interconnections are required. A separate ENABLE COMMAND line would run from controller 20 to each beam steering module. At any one time, the ENABLE COMMAND line to only one beam steering module would be in a logic HI state. In this fashion, the DATA BUS can be time multiplexed between beam steering modules.

In most applications, each beam steering module will be connected to controller 20 via the same STEERING COMMAND line. It will usually be desirable for all beam steering modules to simultaneously change the control inputs to the associated digital phase shifters. In this way, the beam from antenna 10 will be switched most quickly to a new direction and the interconnect circuitry will be simplest. However, it is possible to achieve greater flexibility in the operation of the system if each beam steering module is connected to controller 20 via separate STEERING COMMAND lines.

A separate RECONFIGURE COMMAND Line connects each beam steering module to controller 20. Separate lines are required since each beam steering module in the system may require a different reconfiguration command.

All beam steering modules in a system can be connected to controller 20 via the same TEST DATA BUS. Controller 20 can only request one beam steering module to transmit test data on the TEST DATA BUS at one time.

Having described one embodiment of the invention, it will be apparent to one of skill in the art that various other embodiments could be constructed without departing from the inventive concepts. Thus, any number of registers could be used in register bank 104; the number of bits in each word could also be changed; the primary path 30A and the secondary path 30B could be disconnected from output line 110 by switches separate from phase shift driver 108; or the input to test logic 36 could be taken from the primary and secondary paths before the phase shifter drivers. Additionally, the invention could be employed in systems having phase shifters arranged other than in series with an antenna element. For example, the outputs of several phase shifters could be combined for application to a single antenna element. It is felt, therefore, that this invention should be limited only by the spirit and scope of the appended claims.

What is claimed is:

1. Circuitry comprising:

(a) a plurality of phase shifters;

(b) controller means for computing a plurality of commands for each phase shifter;

(c) for each phase shifter, means for storing the plurality of commands;

(d) a bus connecting each storing means to the controller means;

(e) buffer means for receiving phase shifter commands from the controller over the bus;

(f) for each phase shifter, means for selecting one of the plurality of commands from the storing means and applying the selected command to the phase shifter; and (g) means for simultaneously transferring a plurality of phase shifter commands from the buffer means to the means for storing.

2. In a phased array antenna system of the type having an antenna with a plurality of antenna elements and a plurality of digital phase shifters in series with the plurality of antenna elements, each digital phase shifter having a control input to which control signals generated by a controller are applied to determine the direction of a beam from such antenna, improved circuitry for applying control signals to the digital phase shifters, such circuitry comprising:

(a) a plurality of integrated circuit chips, each coupled to the controller and at least two of the phase shifters, and each comprising means for receiving a plurality of digital control words from the controller, for storing the plurality of digital control words and for applying a portion of the bits in a selected one of the received control words to the control inputs of each of the at least two phase shifters coupled to the integrated circuit chip.

3. The circuitry of claim 2 wherein each of the plurality of integrated circuit chips comprises:

(a) means for storing a plurality of digital control words; and (b) means, responsive to a steering signal from the controller, for selecting one of the plurality of stored digital words and applying a portion of the bits in the word to the control input of each of the phase shifters.

4. The circuitry of claim 3 wherein the steering signals for the selecting means in each of the plurality of integrated circuit chips are connected to the same signal from the controller.

5. The circuitry of claim 2 wherein each of the plurality of integrated circuit chips comprises:

(a) means for receiving a digital word from a bus in response to a signal at a control input.

6. The circuitry of claim 5 additionally comprising:

(a) a bus connecting the controller to each of the plurality of integrated circuit chips; and (b) a plurality of control lines, each line connecting the controller to the control input of each of the integrated circuit chips for receiving a digital word.

7. The circuitry of claim 1 wherein a plurality of the means for storing are fabricated on an integrated circuit chip.

8. The circuitry of claim 7 wherein the integrated circuit chip is connected to the controller means over the bus.

9. The circuitry of claim 8 wherein the plurality of commands comprises at least four commands.

10. The circuitry of claim 1 wherein the means for storing a plurality of commands comprises:

(a) first memory means for storing a plurality of digital words, said first memory means adapted to receive digital words from the controller means over the bus; and (b) second memory means for storing a plurality of digital words, said means adapted to receive a plurality of digital words from the first memory means and to provide one of the plurality of digital words to the phase shifter.

11. A system for controlling a phased array antenna of the type having a plurality of antenna elements, each connected to a phase shifter, said system comprising:

(a) a controller;

(b) a plurality of integrated circuit chips, each one of said chips connected to a portion of the phase shifters, said chips comprising:

(i) first memory means for storing a plurality of phase shifter commands;

(ii) second memory means for storing a plurality of phase shifter commands for each phase shifter connected to the chip;

(iii) control means, responsive to a control signal, for selecting, from the second memory means, one of the plurality of phase shifter commands for each phase shifter and applying the selected phase shifter commands to the phase shifter and for transferring the plurality of phase shifter commands from the first memory means to the second memory means; and (c) bus means, connecting the controller to each of the plurality of chips, for carrying phase shifter commands to the first memory means of each chip.

12. A method of controlling a phased array antenna having a plurality of phase shifters, the method comprising the steps of:

(a) computing in a controller a plurality of phase shifter commands;

(b) transferring, at a first rate, the phase shifter commands to a first plurality of memories connected to each phase shifter;

(c) generating commands to transfer phase shifter commands from a second plurality of memories to the phase shifters at a second rate, faster than the first rate;

(d) transferring the phase shifter commands from the first plurality of memories to the second plurality of memories; and (e) computing new phase shifter commands and repeating steps (b), (c), and (d) above.

* * * * *

UNITED STATES PATENT AND TRADEMARK OFFICE

CERTIFICATE OF CORRECTION

PATENT NO. : 5,027,126

DATED : June 25, 1991

INVENTOR(S) : Behshad Baseghi, Mohammad Mazooji

It is certified that error appears in the above-identified patent and that said Letters Patent is hereby corrected as shown below:

Title page, item [19] and [75]

Delete "Basehgi et al." and replace with-Baseghi et al.--.

Delete "Behshad Basehgi" and replace with --Behshad Baseghi--.

Signed and Sealed this

Third Day of November, 1992

*Attest:*

DOUGLAS B. COMER

*Attesting Officer*

*Acting Commissioner of Patents and Trademarks*